US008911649B2

(12) United States Patent
Wu et al.

(10) Patent No.: US 8,911,649 B2
(45) Date of Patent: Dec. 16, 2014

(54) METHODS OF PREPARING POLYIMIDE FIBERS WITH KIDNEY-SHAPED CROSS-SECTIONS

(75) Inventors: Dezhen Wu, Beijing (CN); Enlin Han, Beijing (CN); Lun Li, Beijing (CN); Hongqing Niu, Beijing (CN); Gongping Shang, Beijing (CN); Shengli Qi, Beijing (CN); Xiaodong Wang, Beijing (CN)

(73) Assignee: Beijing University of Technology, Beijing (CN)

( * ) Notice: Subject to any disclaimer, the term of this patent is extended or adjusted under 35 U.S.C. 154(b) by 38 days.

(21) Appl. No.: 13/428,939

(22) Filed: Mar. 23, 2012

(65) Prior Publication Data

US 2013/0183525 A1 Jul. 18, 2013

(30) Foreign Application Priority Data

Jan. 12, 2012 (CN) ..... 2012 1 0009233

(51) Int. Cl.

| | |
|---|---|
| ***D01D 5/06*** | (2006.01) |
| ***D01D 5/12*** | (2006.01) |
| ***D01D 5/253*** | (2006.01) |
| ***D01D 10/02*** | (2006.01) |
| ***D01D 10/06*** | (2006.01) |
| ***D02J 1/22*** | (2006.01) |
| ***D02J 13/00*** | (2006.01) |
| ***D01D 1/10*** | (2006.01) |

(52) U.S. Cl.

CPC ..... *D01D 1/103* (2013.01); *D01D 1/106* (2013.01)

USPC ... 264/102; 264/169; 264/177.13; 264/178 F; 264/184; 264/210.5; 264/210.8; 264/211.12; 264/211.14; 264/211.15; 264/211.17; 264/233; 264/235

(58) Field of Classification Search

USPC ..... 264/101, 102, 169, 177.13, 178 F, 184, 264/203, 210.5, 210.7, 210.8, 211.12, 264/211.14, 211.15, 211.17, 233, 235

See application file for complete search history.

(56) References Cited

U.S. PATENT DOCUMENTS

| | | | | | |
|---|---|---|---|---|---|
| 3,925,525 | A | * | 12/1975 | LaNieve | 264/177.13 X |
| 3,985,934 | A | * | 10/1976 | Farrissey et al. | 264/184 X |
| 4,921,656 | A | * | 5/1990 | Daumit et al. | 264/177.13 X |
| 5,367,046 | A | * | 11/1994 | Dorogy et al. | 264/184 X |
| 5,374,708 | A | * | 12/1994 | Tamai et al. | 264/177.13 X |
| 5,378,420 | A | * | 1/1995 | Harris et al. | 264/184 |
| 5,716,567 | A | * | 2/1998 | Musina et al. | 264/184 |
| 5,945,054 | A | * | 8/1999 | Meerman et al. | 264/184 |

* cited by examiner

*Primary Examiner* — Leo B Tentoni

(74) *Attorney, Agent, or Firm* — Han IP Corporation

(57) ABSTRACT

The present disclosure provides polyimide fibers with kidney-shaped cross-section and their preparation methods thereof, falling within the technical field of polyimide fiber. Polyimide fibers with kidney-shaped cross-sections are prepared by a continuous, integrated approach, starting from a polyamic acid solution prepared by reacting an aromatic dianhydride with an aromatic diamine. PAA nascent fibers with kidney-shaped cross-sections are obtained by adopting a spinneret having circular orifices under wet spinning process. The kidney-shaped cross-sections are obtained by varying the processing condition, including spinning speed, coagulation bath composition, coagulation temperature, and depth of coagulation bath. After washing and drying, polyamic acid nascent fibers are converted to polyimide fibers with kidney-shaped cross-sections under thermal curing. The integrated preparation methods are suitable for mass industrial production.

16 Claims, 4 Drawing Sheets

METHODS OF PREPARING POLYIMIDE FIBERS WITH KIDNEY-SHAPED CROSS-SECTIONS

CROSS-REFERENCE TO RELATED APPLICATION

This application claims the priority benefit of Chinese Patent Application No. 201210009233.9, filed on Jan. 12, 2012. The entirety of the above-identified patent application is hereby incorporated by reference and made a part of this specification.

TECHNICAL FIELD

The present disclosure relates to the technical field of polyimide fibers and particularly relates to polyimide fibers with kidney-shaped cross-sections and their preparation methods.

BACKGROUND

Fibers with non-circular cross-sections are more desirable since they possess some unique properties compared to those fibers with circular cross-sections. First, they have special optical effect, particularly for those fibers with triangular cross-sections. The triangular cross-section can act as a small prism to split the incoming light and then recombine them, thus producing a desirable lustrous effect. Second, the non-circular structure offers greater surface area. The greater surface area can enhance area coverage, reduce the transparency of textile fabric, and improve pilling resistance. Third, the special shape of non-circular cross-sections could enhance the cohesion among fibers, and provide the bulkiness for better air permeability to fibers. Finally, fibers with non-circular cross-sections also have superior snagging resistance. Therefore, fibers with non-circular cross-sections have been widely used in weaving, needling, knitting, and carpet industries. Polyimide (PI) fibers, as one of the high-performance organic fibers, possess superior thermal resistance to both high and low temperatures, exceptional radiation resistance and chemical solvent resistance, good electrical insulation properties, and excellent mechanical properties. Therefore, PI fibers have become increasingly important in a variety of technological applications, such as applications requiring operating at high or low temperatures, under harsh chemical environments, and in high-performance composites. Having combined characteristics of PI fibers with circular cross-sections, PI fibers with non-circular cross-sections will be very promising materials for special textile and filtration applications.

The most common method for making fibers with non-circular sections is to use non-circular spinneret orifices. Existing PI fibers with non-circular sections are prepared by this traditional method. For example, the commercially available product, P84, which is a PI fiber with a trilobal cross-section, is prepared through trilobal spinneret orifices. P84 has been widely used as a high temperature resistant material for filtration. However, since the size of the spinneret orifices had to be very small, it is difficult to machining spinneret plates having circular orifices, and it is even more difficult and costly to machining spinnerets plates having non-circular orifices. Therefore, there remains a need to develop methods for making PI fibers with non-circular cross-sections without using non-circular shaped spinneret orifices, to greatly simplify the manufacturing process, improve the production efficiency and lower the production cost.

SUMMARY

The object of the present disclosure is to provide PI fibers with kidney-shaped cross-sections and their preparation methods in order to address the manufacturing difficulties existing in the prior art. The whole production process is carried out in a continuous way without any interruption, thus is simple, cheaper and more efficient, and it is suitable for mass production in industry.

In one aspect, a polyimide fiber with a kidney-shaped cross-section may be provided, wherein a polyimide is prepared by reacting an aromatic dianhydride with an aromatic diamine to form a polyamic acid, followed by converting the polyamic acid to the corresponding polyimide.

In some embodiments, the dianhydride is a pyromellitic dianhydride (PMDA).

In some embodiments, the diamine is a 4,4'-oxydianiline (ODA), a p-phenylene diamine (PPDA), or a mixture thereof.

In another aspect, an integrated method for preparing polyimide fibers with kidney-shaped cross-sections may comprises preparing wet-spinning a polyamic acid spinning solution through a spinneret having circular orifices; entering as-spun polyamic acid fibers into at least one coagulation bath to form polyamic acid nascent fibers with kidney-shaped cross-sections, wherein the coagulation bath has a depth ranging from about 5 mm to about 800 mm, and wherein the coagulation bath contains a solvent of a temperature ranging from about to about −10° C. to about 50° C.; and converting polyamic acid nascent fibers with kidney-shaped cross-sections to corresponding polyimide fibers with kidney-shaped cross-sections.

In some embodiments, the spinneret is spun at a rate ranging from about 0.1 m/min to about 100 m/min.

In some embodiments, the polyamic acid spinning solution is prepared by reacting an aromatic dianhydride with an aromatic diamine.

In some embodiments, the dianhydride is a pyromellitic dianhydride (PMDA).

In some embodiments, the diamine is a 4,4'-oxydianiline (ODA), a p-phenylene diamine (PPDA), or a mixture thereof.

In some embodiments, a solvent in the coagulation bath is water, methanol, ethanol, glycol, acetone, methylbenzene, N,N-dimethyl formamide (DMF), N,N-dimethyl acetamide (DMAc), N-methyl pyrrolidone (NMP), dimethyl sulfoxide (DMSO), or a mixture thereof.

In some embodiments, a quantity of the at least one coagulation bath is up to 6.

In some embodiments, the converting polyamic acid nascent fibers to corresponding polyimide fibers is conducted by thermal curing and stretching at stepwise increased temperatures ranging from about 120° C. to about 600° C.

In some embodiments, the integrated method for preparing polyimide fibers with kidney-shaped cross-sections may further comprises filtering the polyamic acid spinning solution; and degassing the filtered polyamic acid spinning solution under vacuum.

In some embodiments, the integrated method for preparing polyimide fibers with kidney-shaped cross-sections may further comprises washing the polyamic acid nascent fibers by water at a temperature ranging from about 0° C. to about 100° C.; drying the polyamic acid nascent fibers at a temperature ranging from about 60° C. to about 240° C.; thermally annealing the polyimide fibers with kidney-shaped cross-sections at a temperature ranging from about 400° C. to about 800° C.; and winding the polyimide fibers with kidney-shaped cross-sections.

In some embodiments, each of the temperatures in washing, drying, and thermal annealing is respectively increased incrementally.

In another aspect, an integrated method for preparing polyimide fibers with kidney-shaped cross-sections may comprise preparing a polyamic acid spinning solution by reacting an aromatic dianhydride with an aromatic diamine; filtering the polyamic acid spinning solution; degassing the filtered polyamic acid spinning solution under vacuum; wet-spinning the degassed polyamic acid solution through a spinneret having circular orifices at a rate of about 0.1 m/min to about 100 m/min; entering as-spun polyamic acid fibers into at least one coagulation bath having a depth ranging from 5 mm to 800 mm and a solvent of a temperature ranging from about −10° C. to about 50° C.; washing the polyamic acid nascent fibers by water at a temperature of about 0° C. to about 100° C.; drying the polyamic acid nascent fibers at a temperature of about 60° C. to about 240° C.; thermally curing and stretching the polyamic acid nascent fibers at stepwise increased temperatures of about 120° C. to about 600° C. to convert the polyamic acid fibers to corresponding polyimide fibers with kidney-shaped cross-sections; thermally the annealing polyimide fibers with kidney-shaped cross-sections at a temperature of about 400° C. to about 800° C.; and winding the polyimide fibers with kidney-shaped cross-sections.

In some embodiments, the dianhydride is a pyromellitic dianhydride (PMDA).

In some embodiments, the diamine is a 4,4'-oxydianiline (ODA), a p-phenylene diamine (PPDA), or a mixture thereof.

In some embodiments, the solvent in the at least one coagulation bath is water, methanol, ethanol, glycol, acetone, methylbenzene, N,N-dimethyl formamide (DMF), N,N-dimethyl acetamide (DMAc), N-methyl pyrrolidone (NMP), dimethyl sulfoxide (DMSO), or a mixture thereof.

In some embodiments, a quantity of the at least one coagulation bath is up to 6.

In some embodiments, each of the temperatures in washing, drying, thermal curing and stretching, and thermal annealing is respectively increased incrementally.

DETAILED DESCRIPTION OF SAMPLE EMBODIMENTS

The present disclosure provides polyimide (PI) fibers with kidney-shaped cross-sections and methods of their preparation without using spinneret having non-circular orifices. PI fibers with kidney-shaped cross-sections are obtained from corresponding polyamic acid (PAA) nascent fibers prepared by varying the processing conditions, such as spinning speed, coagulation bath composition, coagulation temperature, and the depths of the coagulation bath. Featuring by simple preparation process, high production efficiency, as well as low raw materials cost and energy consumption, PI fiber-making methods disclosed in the present disclosure are applicable to large-scale industrial production. Compared to PI fibers with circular cross-sections, PI fibers with kidney-shaped cross-sections obtained in accordance with the present disclosure, have higher specific surface areas, higher cohesion, and larger friction coefficient. They also have greatly improved drapability and wrinkle resistance. PI fibers with kidney-shaped cross-sections can be used as high-temperature resistant filtering materials and high- and low-temperature resistant textile materials.

As used herein, "aromatic" means compounds having aromaticity characteristics. Representative aromatic group includes benzene, biphenyl, and naphthalene.

Figure 1:
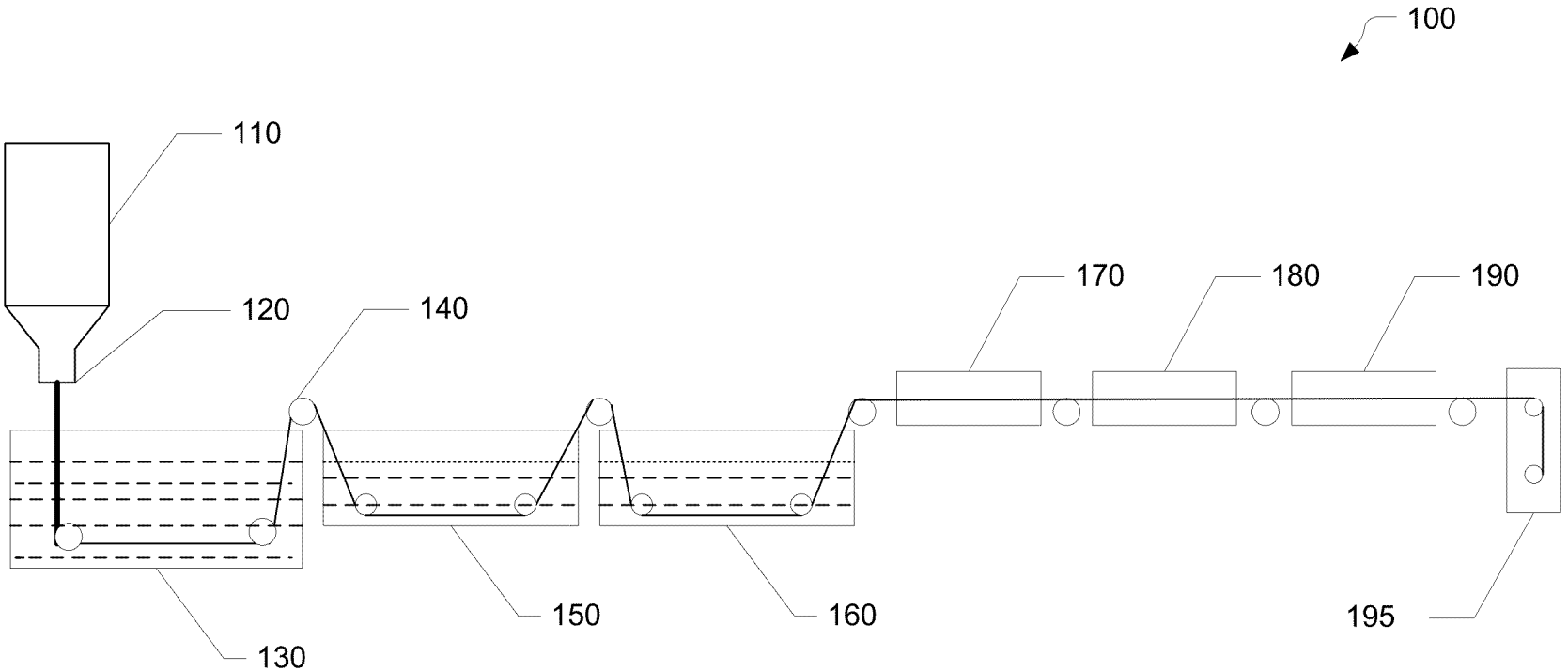
FIG. 1 is a schematic diagram of a wet-spinning system to implement the integrated method for preparing polyimide fibers with kidney shaped cross-sections.

FIG. 1 illustrates an example system that can be utilized to implement the integrated PI fiber preparation methods in accordance with at least some embodiments described herein. Referring to FIG. 1, an example PI fiber making system 100 may include a spinning barrel containing a PAA solution 110, a spinneret plate having circular orifices 120, a first coagulation bath 130, a godet roller 140, a second coagulation bath 150, a washing bath 160, a hot plate 170, a heating furnace 180, an annealing furnace 190, and a winding device 195.

Figure 2:
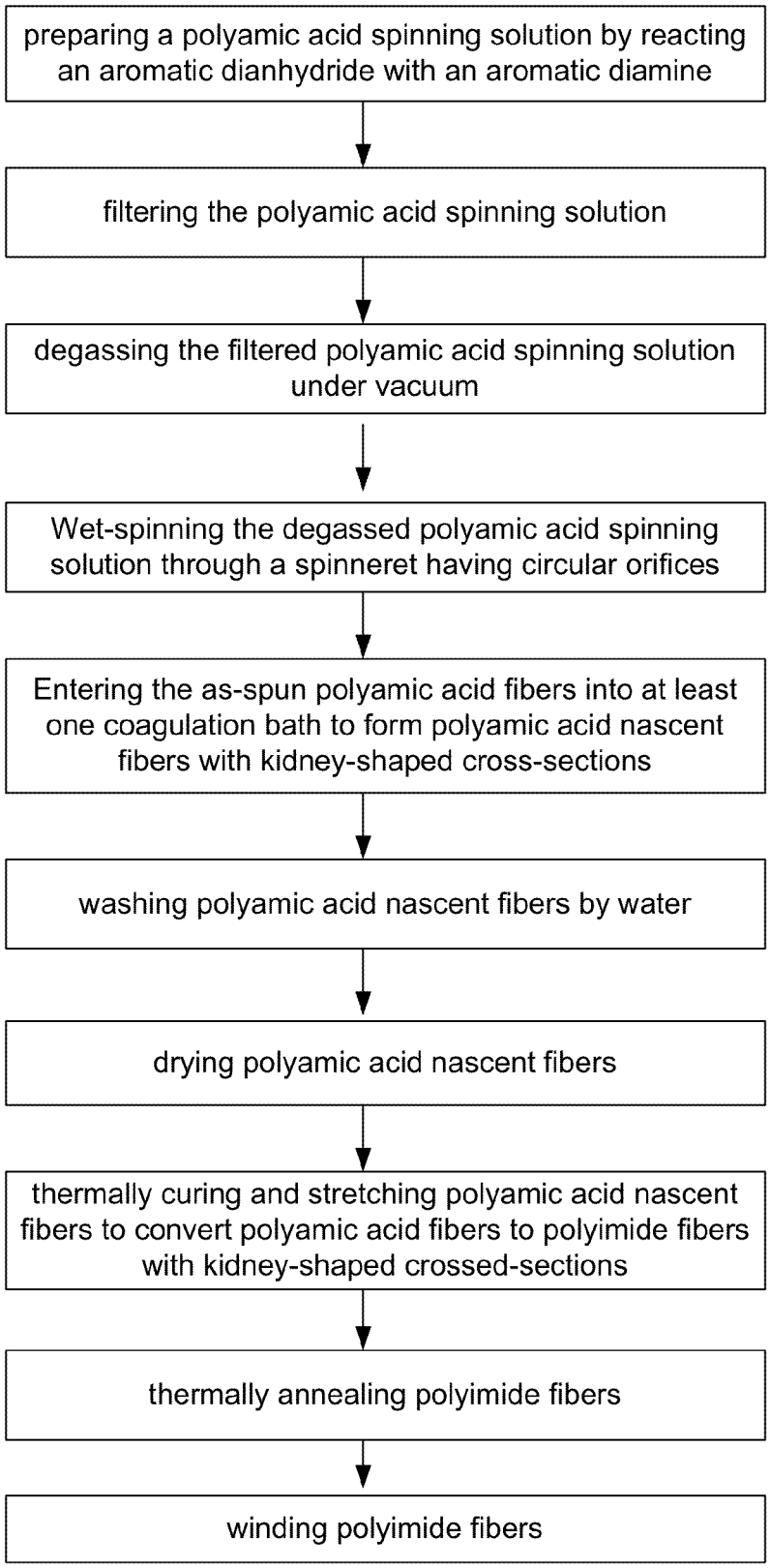
FIG. 2 is a flow diagram of one illustrated method for making polyimide fibers with kidney-shaped cross-sections.

FIG. 2 depicts a flow diagram of one illustrated method for making PI fibers with kidney-shaped cross-sections. PI fibers with kidney-shaped cross-sections are prepared continuously by integrally combining the following process steps.

First, a PAA solution is prepared by reacting an aromatic dianhydride with an aromatic diamine. The PAA content in the solution ranges from 3% to 30%. Representative aromatic dianhydrides include pyromellitic dianhydride (PMDA). Representative aromatic diamines include 4,4'-oxydianiline (ODA) and p-phenylene diamine (PPDA). The PAA solution can be prepared by homocondensation of either ODA or PPDA with PMDA, or by heterocodensation of a mixture of ODA and PPDA with PMDA. The PAA solution can also be prepared by mixing a post-polymerization solution of ODA and PMDA and a post-polymerization solution PPDA and PMDA.

After filtering and degassing under vacuum, the PAA solution is then extruded through a spinneret having circular orifices, and entered into a coagulation bath. The coagulation process can optionally be carried out in several steps, where the as-spun PAA fibers are entered into at least one coagulation bath, and up to six coagulation baths can be used. For example, in FIG. 1, two coagulation baths are used in the coagulation process. The as-spun PAA fibers coming out from the first coagulation bath are entered into the second coagulation bath before washing. The kidney-shaped cross-sections are obtained by varying the spinning speed and the coagulation process conditions, including coagulation bath composition coagulation temperature, and the depth of the coagulation bath. The spinning speed can range from 0.1 m/min to 100 m/min. Representative solvent used in the coagulation bath includes water, methanol, ethanol, glycol, acetone, methylbenzene, N,N-dimethyl formamide (DMF), N,N-dimethyl acetamide (DMAc), N-methyl pyrrolidone (NMP), dimethyl sulfoxide (DMSO), or a mixture thereof. The coagulation bath temperature ranges from −10° C. to 50° C. The depth of coagulation bath ranges from 5 mm to 800 mm.

In the post-processing steps, PAA nascent fibers are first washed by water at a temperature ranging from 0° C. to 100° C. to remove solvent, dried at a temperature ranging from 60° C. to 240° C., and then thermally cured and stretched at stepwise increased temperatures ranging from 120° C. to 600° C. to convert into PI fibers with kidney-shaped cross-sections. The resulting PI fibers are thermally annealed at a temperature ranging from 400° C. to 800° C. Finally, the PI fibers with kidney-shaped cross-sections are rolled up. The temperature in these steps is increased incrementally.

The present disclosure possesses a number of advantages as described below.

First, the present disclosure provides methods for preparing PI fibers with non-circular sections by using a spinneret having circular orifices. The kidney-shaped cross-sections are obtained by controlling the process conditions, such as spinning speed, coagulation bath composition, coagulation temperature, and depth of the coagulation bath. Therefore, a spinneret having kidney-shaped orifices is not required. This will greatly simplify the design and processing of the spinneret having irregular orifices and makes easier to control the spinning process. The specific surface area of fibers with kidney-shaped cross-sections is at least 1.3 times larger than that of fibers with circular cross-sections.

Second, the present disclosure provides methods to make PI fibers in a continuous and integrated manner by combining the following processing steps, including spinning, coagulating, washing, drying, thermal cyclization and drawing, thermal annealing and winding. Featuring a simple and continuous preparation process and high preparation efficiency, the methods are applicable to large-scale industrial production. The methods disclosed herein are superior to the traditional two-step method for preparing PI fibers starting from a PAA solution. In the traditional two-step process, the PAA precursor fibers are first obtained from a PAA solution. After rolling-up the PAA precursor fibers, the PI fibers are prepared through chemical cyclization or thermal cyclization, or the combination of chemical and heating cyclization. The method disclosed in the present disclosure is also superior to the traditional one-step process for preparing PI fibers from a PI solution, where a PI solution is directly used for spinning. Due to the poor solubility of PI, environmentally unfriendly and highly toxic phenol-based solvents are normally used. In addition, only a few kinds of PIs can be dissolved in these phenol-based solvents.

Furthermore, all the raw materials, aromatic dianhydrides and aromatic diamines adopted in the present disclosure are considerably inexpensive, and all the unreacted raw materials and solvents can be recovered for further utilization. Thus, the manufacturing cost is greatly reduced.

The present disclosure will further described hereinafter by way of Example. However, the present invention is not limited by the following Examples.

EXAMPLES

Example 1

A solution of 15% PAA was prepared by copolymerizing PMDA and ODA. The PAA solution was filtered, degassed under vacuum, and then spun into fibers through a spinneret having circular orifices. The spinning speed was adjusted by changing the rotation speed of a metering pump and was set at 15, 20 or 25 m/min. The fibers extruded from the circular spinneret orifices were entered into coagulation baths containing pure water of 25° C. to afford PAA nascent fibers with kidney-shaped cross-sections. Four coagulation baths were used. The depths of the coagulation baths were 100 mm. PAA nascent fibers with kidney-shaped cross-sections were directly washed by water of 20-80° C. to remove the solvent, dried at 80° C. to remove water, and then heated at temperatures ranging from 160-400° C. to induce cyclization converting PAA fibers into PI fibers. After annealing at 500° C. under nitrogen, the resulting PI fibers with kidney-shaped cross-sections were finally rolled up.

Figure 3:
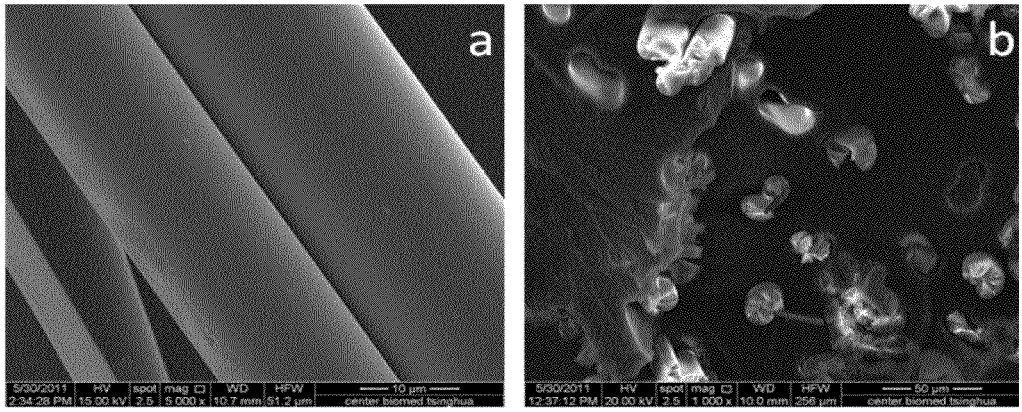
FIGS. 3*a*-3*b* are scanning electron microscope (SEM) images of (a) surfaces and (b) cross-sections of polyamic acid fibers with kidney-shaped cross-sections in accordance with the present disclosure.

The surfaces and cross-sections of the obtained PAA fibers are shown in FIGS. 3*a*-3*b*.

Example 2

A solution of 20% PAA was prepared by copolymerizing PMDA and ODA. The PAA solution was filtered, degassed under vacuum, and then spun into fibers through a spinneret with circular orifices. The spinning speed was adjusted by changing the rotation speed of a metering pump and was set at 20 m/min. The fibers extruded from the circular spinneret orifices were entered into a coagulation bath containing water to afford PAA nascent fibers with kidney-shaped cross-sections. The temperature of the coagulation bath was set at 10, 25 or 40° C., respectively, and the depth of the coagulation bath was 50 mm. PAA fibers with kidney-shaped cross-sections were directly washed by water of 40-80° C. to remove the solvent, dried at 100° C. to remove the water, and then heated at temperatures ranging from 160-450° C. to induce cyclization converting PAA fibers into corresponding PI fibers. After annealing at 520° C. under nitrogen, the resulting PI fibers with kidney-shaped cross-sections were finally rolled up.

Figure 4:
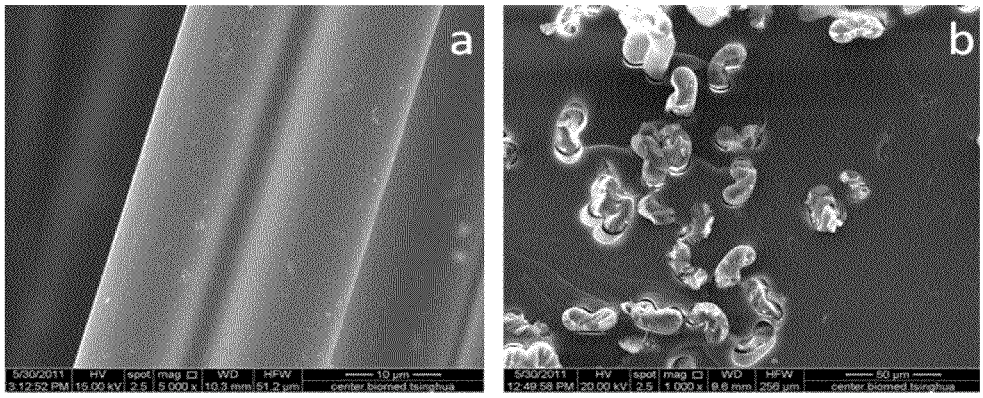
FIGS. 4*a*-4*b* are SEM images of (a) surfaces and (b) cross-sections of polyimide fibers with kidney-shaped cross-sections in accordance with the present disclosure.

The surfaces and cross-sections of the obtained PI fibers are shown in FIGS. 4*a*-4*b*.

Example 3

A solution of 25 PAA was prepared by copolymerizing PMDA and ODA. The PAA solution was filtered, degassed under vacuum, and then spun into fibers through a spinneret having circular orifices. The spinning speed was adjusted by changing the rotation speed of a metering pump, and was set at 10 m/min. The fibers ejected from the circular spinneret orifices were directly introduced into coagulation baths to afford PAA nascent fibers with kidney-shaped cross-sections. Five coagulation baths were used. The solvent used in coagulation baths were a mixture of water/ethanol, water/DMAc or water/glycol. The temperatures of the coagulation baths were set at 30° C. The depths of the coagulation baths were 50 mm. The PAA fibers with kidney-shaped cross-sections were directly washed by water of 30-95° C. to remove the solvent, dried at 120° C. to remove the water, and then heated and drawn at temperatures ranging from 150-480° C. to induce cyclization converting PAA fibers into corresponding PI fibers. After annealing at 500° C. under nitrogen, the resulting PI fibers with kidney-shaped cross-sections were finally rolled up.

Examples 4

A solution of 15 PAA was prepared by copolymerizing PMDA with ODA and PPDA. The PAA solution was filtered, degassed under vacuum, and then spun into fibers through a spinneret having circular orifices. The spinning speed was adjusted by changing the rotation speed of a metering pump, and was set at 15 m/min. The fibers ejected from the circular spinneret orifice were directly introduced into coagulation baths containing water of −5° C. to afford PAA nascent fibers with kidney-shaped cross-sections. Four coagulation baths were used. The solvent used in coagulation baths were a mixture of water/ethanol in a volume ration of 50/50, 70/30, or 90/10. The depths of the coagulation bath were 250 mm. PAA fibers with kidney-shaped cross-sections were directly washed by water of 20-90° C. to remove the solvent, dried at 140° C. to remove the water, and then heated and drawn at temperatures ranging from 160-500° C. to induce cyclization converting PAA fibers into corresponding PI fibers. After annealing at 560° C. under nitrogen, the resulting PI fibers with kidney-shaped cross-sections were finally rolled up.

Example 5

A solution of 12% PAA was prepared by mixing a post-polymerization solution of PMDA and ODA and a post-polymerization solution of PMDA and PPDA. The PAA solution was filtered, degassed under vacuum, and then spun into fibers through a spinneret having circular orifices. The spinning speed was adjusted by changing the rotation speed of a metering pump, and was set at 30 m/min. The fibers ejected from the circular spinneret orifices were directly introduced into a coagulation bath containing water of 35° C. to afford PAA nascent fibers with kidney-shaped cross-sections. The depth of the coagulation bath was 200, 400 or 600 mm, respectively. PAA fibers with kidney-shaped cross-sections were directly washed by water of 20-90° C. to remove the solvent, dried at 160° C. to remove the water, and then heated and drawn at temperatures ranging from 200-500° C. to induce cyclization converting PAA fibers into corresponding PI fibers. After annealing at 540° C. under nitrogen, the resulting PI fibers with kidney-shaped cross-sections were finally rolled up.

Example 6

A solution of 8% PAA was prepared by copolymerizing PMDA and ODA. The PAA solution was filtered, degassed under vacuum, and then spun into fibers through a spinneret having circular orifices. The spinning speed was adjusted by changing the rotation speed of a metering pump, and was set at 45 m/min. The fibers ejected from the circular spinneret orifices were directly introduced into coagulation baths to afford PAA nascent fibers with kidney-shaped cross-sections. Six coagulation baths were used. The solvent used in the coagulation baths was a mixture of water, ethanol and DMC. Temperatures of the coagulation baths were set at 45° C. The depths of the coagulation baths were 700 mm. PAA fibers with kidney-shaped cross-sections were directly washed by water of 30-100° C. to remove the solvent, dried at 80-240° C. to remove the water, and then heated and drawn at temperatures ranging from 200-550° C. to induce cyclization converting PAA fibers into corresponding PI fibers. After annealing at 700° C. under nitrogen, the resulting PI fibers with kidney-shaped cross-sections were finally rolled up.

What is claimed is:

1. An integrated method for preparing polyimide fibers with kidney-shaped cross-sections, comprising:

wet-spinning a polyamic acid spinning solution through a spinneret having circular orifices;

entering as-spun polyamic acid fibers into at least one coagulation bath to form polyamic acid nascent fibers with kidney-shaped cross-sections, wherein the coagulation bath has a depth ranging from about 5 mm to about 800 mm, wherein the coagulation bath contains a solvent including water or a mixture of water and an organic solvent, and wherein the coagulation bath has a temperature ranging from about −10° C. to about 50° C.; and converting polyamic acid nascent fibers with kidney-shaped cross-sections to corresponding polyimide fibers with kidney-shaped cross-sections, wherein the polyamic acid spinning solution is spun at a rate ranging from about 0.1 m/min to about 100 m/min.

2. The method of claim 1, wherein the polyamic acid spinning solution is prepared by reacting an aromatic dianhydride with an aromatic diamine.

3. The method of claim 2, wherein the dianhydride is a pyromellitic dianhydride (PMDA).

4. The method of claim 2, wherein the diamine is a 4,4'-oxydianiline (ODA), a p-phenylene diamine (PPDA), or a mixture thereof.

5. The method of claim 1, wherein the organic solvent is methanol, ethanol, glycol, acetone, methylbenzene, N,N-dimethyl formamide (DMF), N,N-dimethyl acetamide (DMAc), N-methyl pyrrolidone (NMP), dimethyl sulfoxide (DMSO), or a mixture thereof.

6. The method of claim 1, wherein a number of the at least one coagulation bath is up to 6.

7. The method of claim 1, wherein the converting polyamic acid nascent fibers to corresponding polyimide fibers is conducted by thermal curing and stretching at stepwise increased temperatures ranging from about 120° C. to about 600° C.

8. The method of claim 1, further comprising:

filtering the polyamic acid spinning solution; and degassing the filtered polyamic acid spinning solution under vacuum.

9. The method of claim 1, further comprising:

washing the polyamic acid nascent fibers by water at a temperature ranging from about 0° C. to about 100° C.;

drying the polyamic acid nascent fibers at a temperature ranging from about 60° C. to about 240° C.;

thermally annealing the polyimide fibers with kidney-shaped cross-sections at a temperature ranging from about 400° C. to about 800° C.; and winding the polyimide fibers with kidney-shaped cross-sections.

10. The method of claim 9, wherein each of the temperatures in washing, drying, and thermal annealing is respectively increased incrementally.

11. An integrated method for preparing polyimide fibers with kidney-shaped cross-sections, comprising:

preparing a polyamic acid spinning solution by reacting an aromatic dianhydride with an aromatic diamine;

filtering the polyamic acid spinning solution;

degassing the filtered polyamic acid spinning solution under vacuum;

wet-spinning the degassed polyamic acid solution through a spinneret having circular orifices at a spinning rate of about 0.1 m/min to about 100 m/min;

entering as-spun polyamic acid fibers into at least one coagulation bath to form polyamic acid nascent fibers with kidney-shaped cross-sections by controlling process conditions associated with at least two of the spinning rate, a composition of the at least one coagulation bath, a coagulation temperature, and a depth of the coagulation bath, wherein the coagulation bath has the depth ranging from about 5 mm to about 800 mm, wherein the coagulation bath contains a solvent including water or a mixture of water and an organic solvent, and wherein the coagulation bath has the coagulation temperature ranging from about −10° C. to about 50° C.;

washing the polyamic acid nascent fibers by water at a temperature of about 0° C. to about 100° C.;

drying the polyamic acid nascent fibers at a temperature of about 60° C. to about 240° C.;

thermally curing and stretching the polyamic acid nascent fibers at stepwise increased temperatures of about 120° C. to about 600° C. to convert the polyamic acid fibers to corresponding polyimide fibers with kidney-shaped cross-sections;

thermally annealing the polyimide fibers with kidney-shaped cross-sections at a temperature of about 400° C. to about 800° C.; and winding the polyimide fibers with kidney-shaped cross-sections.

12. The method of claim 11, wherein the dianhydride is a pyromellitic dianhydride (PMDA).

13. The method of claim 11, wherein the diamine is a 4,4'-oxydianiline (ODA), a p-phenylene diamine (PPDA), or a mixture thereof.

14. The method of claim 11, wherein the organic solvent is methanol, ethanol, glycol, acetone, methylbenzene, N,N-dimethyl formamide (DMF), N,N-dimethyl acetamide (DMAc), N-methyl pyrrolidone (NMP), dimethyl sulfoxide (DMSO), or a mixture thereof.

15. The method of claim 11, wherein a number of the at least one coagulation bath is up to 6.

16. The method of claim 11, wherein each of the temperatures in washing, drying, thermal curing and stretching, and thermal annealing is respectively increased incrementally.

* * * * *